US012779524B2

(12) United States Patent
Conaway

(10) Patent No.: US 12,779,524 B2
(45) Date of Patent: Nov. 3, 2026

(54) LINEAR BEARING PUSHER AND TOOLING ASSEMBLY, SYSTEM, AND METHOD

(71) Applicant: D.N.C. Hydraulics, L.L.C., Rawson, OH (US)

(72) Inventor: Cody Conaway, Findlay, OH (US)

(73) Assignee: D.N.C. Hydraulics, L.L.C., Rawson, OH (US)

( * ) Notice: Subject to any disclaimer, the term of this patent is extended or adjusted under 35 U.S.C. 154(b) by 172 days.

(21) Appl. No.: 18/812,085

(22) Filed: Aug. 22, 2024

(65) Prior Publication Data

US 2026/0054307 A1 Feb. 26, 2026

(51) Int. Cl.
*B21D 51/26* (2006.01)

(52) U.S. Cl.
CPC ..... *B21D 51/26* (2013.01)

(58) Field of Classification Search
CPC ..... B21D 51/26; B21D 51/2615; B21D 51/2623; B21D 51/263; B21D 51/2638
See application file for complete search history.

(56) References Cited

U.S. PATENT DOCUMENTS

| | | | | |
|---|---|---|---|---|
| 11,207,724 | B2 * | 12/2021 | Marchadour | B65D 17/08 |
| 11,208,271 | B2 * | 12/2021 | Mercer | B21D 51/2638 |
| 11,306,807 | B2 | 4/2022 | Pallini et al. | |
| 11,370,015 | B2 * | 6/2022 | Mercer | B21D 51/2692 |
| 11,897,020 | B2 | 2/2024 | Hanafusa et al. | |
| 2007/0227859 | A1 | 10/2007 | Marshall et al. | |
| 2013/0118299 | A1 | 5/2013 | Pallini | |
| 2023/0048155 | A1 | 2/2023 | McGuire et al. | |

FOREIGN PATENT DOCUMENTS

| | | | |
|---|---|---|---|
| CA | 2547384 | C | 12/2012 |

* cited by examiner

*Primary Examiner* — Matthew Katcoff
(74) *Attorney, Agent, or Firm* — Jacob M. Ward; Ward Law Office LLC

(57) ABSTRACT

The present disclosure provides a linear bearing pusher and tooling assembly including a housing, a first bearing, a second bearing, a shaft, a tooling adapter, a pusher, and a bolt. The housing can have a first end and a second end. The first bearing can have a first hole formed therethrough and can be positioned at the first end of the housing. The second bearing can have a second hole formed therethrough and can be positioned at the second end of the housing. The shaft can be movably disposed within the housing. The shaft can have a friction reducing coating. The tooling adapter or the pusher can be disposed inside the shaft. The bolt can be disposed through and attach the pusher and the tooling adapter to the shaft. The shaft can be permitted to move in a reciprocating manner within the housing without grease.

20 Claims, 8 Drawing Sheets

LINEAR BEARING PUSHER AND TOOLING ASSEMBLY, SYSTEM, AND METHOD

FIELD

The present technology relates to mechanical assemblies used in the canning industry, specifically to a high-speed linear bearing pusher and tooling assembly.

INTRODUCTION

This section provides background information related to the present disclosure which is not necessarily prior art.

The canning industry has long relied on mechanical assemblies to facilitate the efficient production of metal cans, which are necessary for food and beverage storage. Traditional canning equipment includes pushers and tooling assemblies that manipulate the shape and structure of cans during the manufacturing process. These assemblies typically involve a series of mechanical components such as shafts, bearings, and housings that work in concert to form features like the neck of the can.

One of the primary challenges in traditional canning operations is the need for frequent maintenance, primarily due to the lubrication requirements of mechanical components. Bearings, which facilitate the smooth operation of moving parts, traditionally require regular greasing to prevent wear and tear and to ensure smooth operation. This requirement for continual lubrication not only increases the operational costs due to the need for grease and labor but also poses environmental concerns with the disposal of used lubricants.

Moreover, the wear resistance of components such as shafts in these assemblies has been another concern. Traditional materials and coatings used in shafts often fall short in terms of durability, especially under the high-speed conditions typical in modern canning lines. This leads to frequent downtime for replacement and maintenance, disrupting production and increasing costs.

Additionally, the precision of mechanical movements in canning operations is important for the quality of the final product. The surface finish of shafts and their interaction with bearings can significantly impact the consistency and quality of the canning process. Current solutions often lack the necessary precision in component finishes, leading to less efficient operations and potential quality issues in the cans produced.

Accordingly, there is a need for a grease-less linear bearing pusher and tooling assembly.

SUMMARY

In concordance with the instant disclosure, a grease-less linear bearing pusher and tooling assembly, has surprisingly been discovered.

A linear bearing pusher and tooling assembly is provided. The assembly can include a housing, a first bearing, a second bearing, a shaft, a tooling adapter, a pusher, and a bolt. The housing can have a first end, a second end, an outer surface, and an inner surface. The inner surface can define a cavity. The first bearing can have a first hole formed therethrough and can be positioned at the first end of the housing. The second bearing can have a second hole formed therethrough and can be positioned at the second end of the housing. The shaft can be movably disposed within the cavity of the housing. The shaft can have a first portion and a second portion. The first portion of the shaft can be disposed through the first hole of the first bearing and the second portion can be disposed through the second hole of the second bearing. The shaft can have an interior surface and an exterior surface. The exterior surface can have a friction reducing coating. The tooling adapter can be disposed inside the shaft. Alternatively, the pusher can be disposed inside the shaft. The bolt can be disposed through the pusher or the tooling adapter to attach the pusher or the tooling adapter to the shaft. The shaft can be permitted to move in a reciprocating manner within the housing without grease.

In another embodiment, a product manufacturing system is provided. The product manufacturing system can include a product indexing machine, a first linear bearing pusher and tooling assembly, a second linear bearing pusher and tooling assembly, and a first tooling. The product indexing machine can be configured to move a product from a first processing location to a second processing location. The first linear bearing pusher and tooling assembly and the second linear bearing pusher and tooling assembly can be the linear bearing pusher and tooling assembly as described herein. The first tooling can be attached to the tooling adapter of the first linear bearing pusher and tooling assembly and can be configured to process the product at the first processing location. The pusher can be attached to the second linear bearing pusher and tooling assembly and can be configured to process the product at the second processing location.

In certain embodiments, a method for forming a product via product indexing machine is disclosed. The method can include providing the product manufacturing system as described herein. The product can be provided at the first processing location. The method can include causing the first tooling to process the product by an operation of the first linear bearing pusher and tooling assembly and moving the product from the first processing location to the second processing location. The method can include causing the pusher to process the product by an operation of the second linear bearing pusher and tooling assembly, whereby the product is manufactured.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

DETAILED DESCRIPTION

Figure 1:
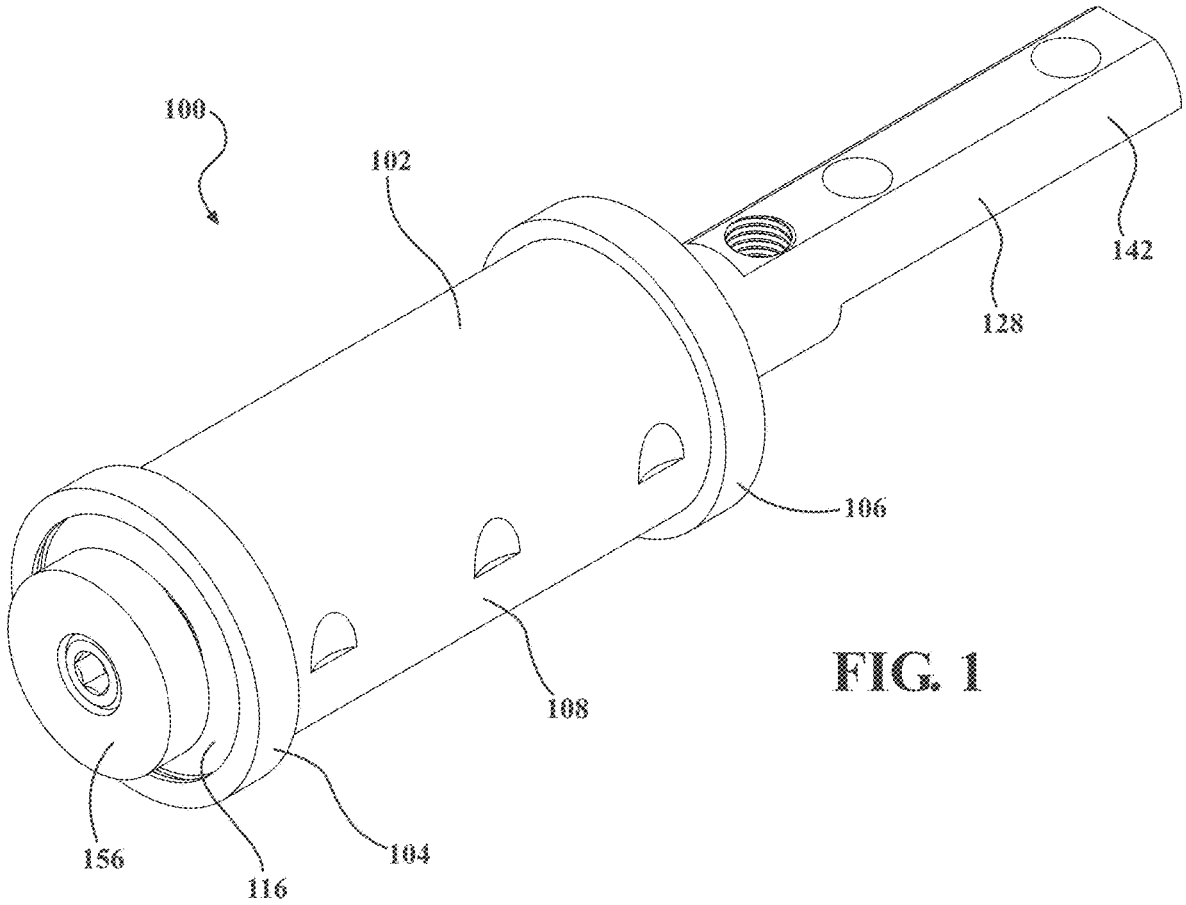
FIG. 1 is a top perspective view of a linear bearing pusher and tooling assembly with a pusher.
Figure 2A:
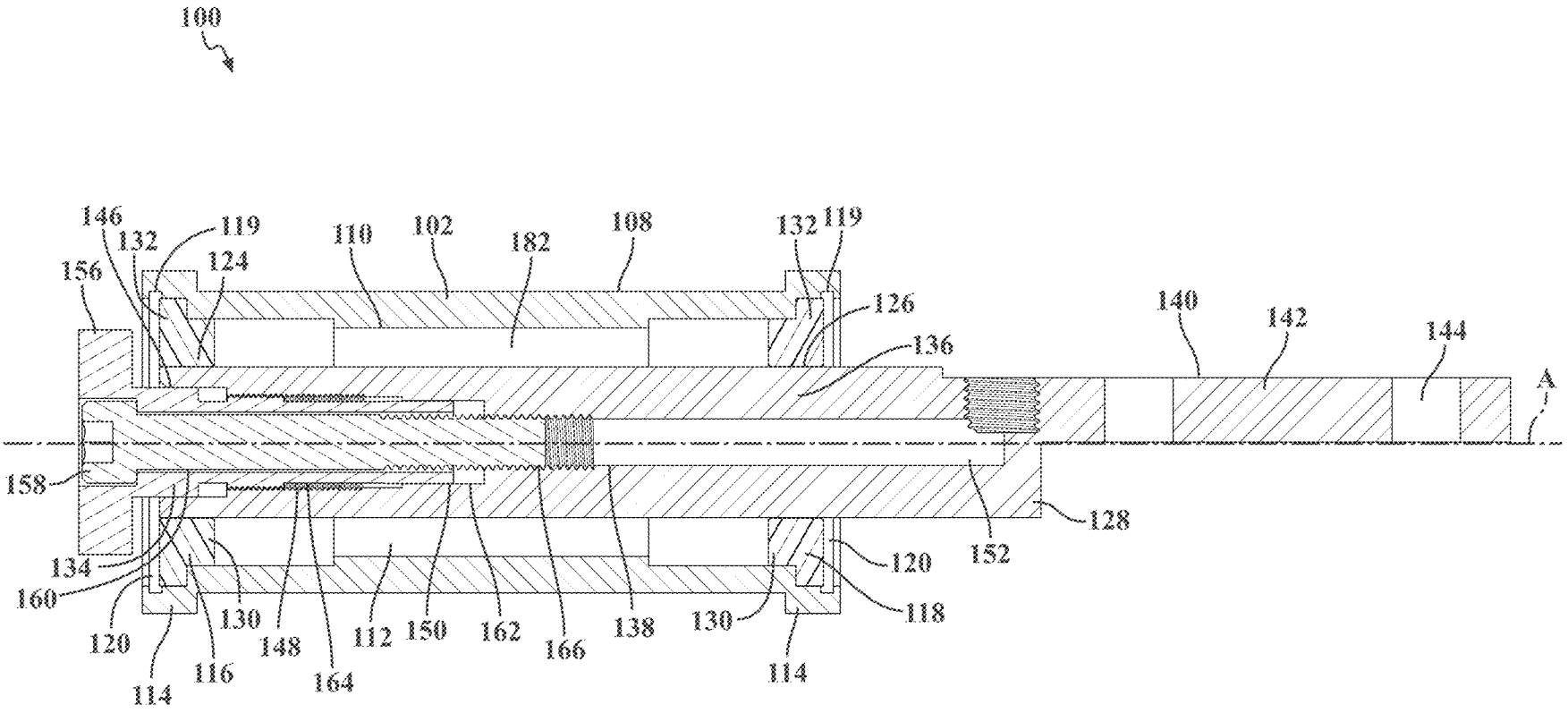
FIG. 2A is a side elevation cross sectional view of the linear bearing pusher and tooling assembly with the pusher in a first position.
Figure 2B:
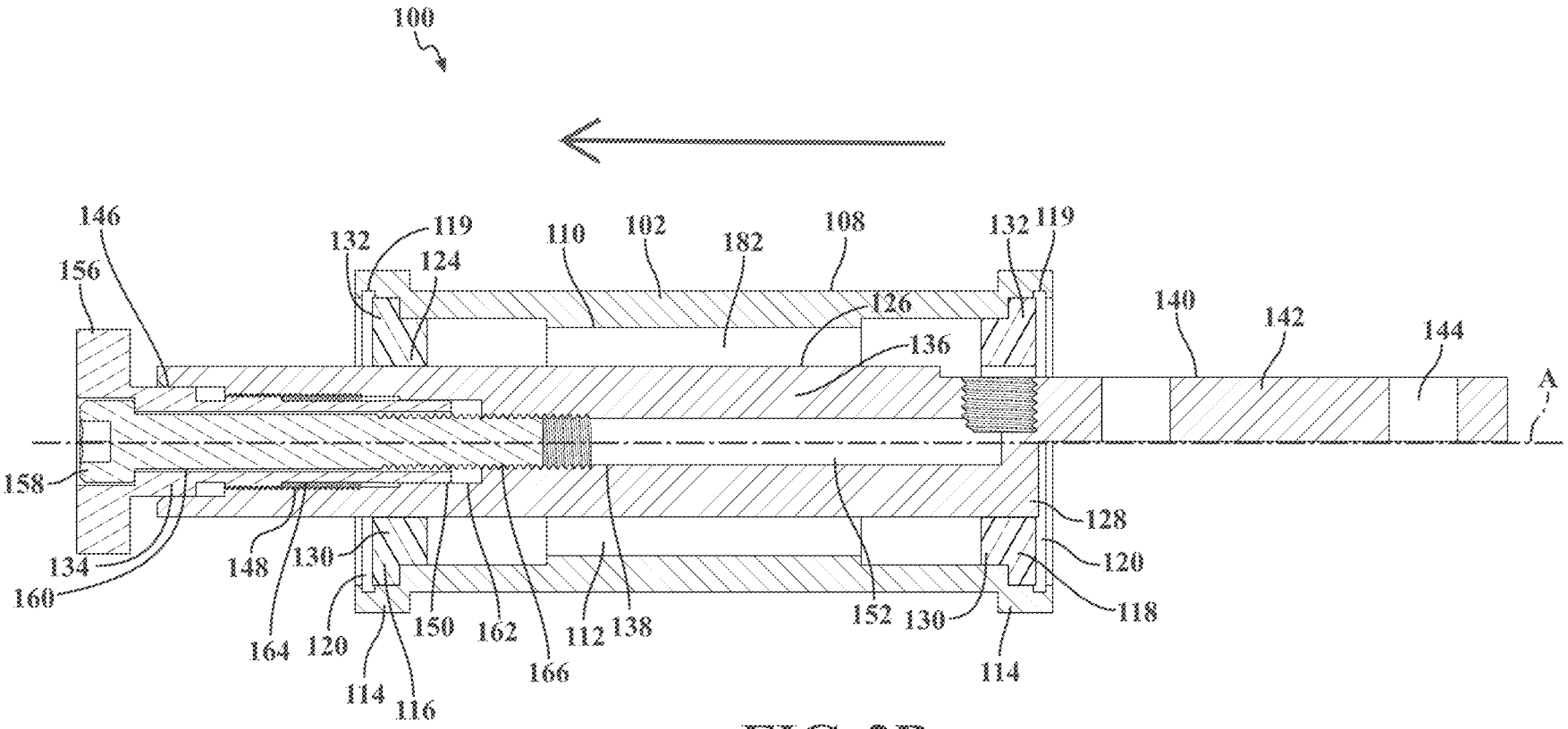
FIG. 2B is a side elevation cross sectional view of the linear bearing pusher and tooling assembly with the pusher in a second position for interacting with a product in operation.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology improves a linear bearing pusher and tooling assembly 100, as shown generally in FIGS. 1-5. The linear bearing pusher and tooling assembly 100 can be a high-speed linear bearing pusher and tooling assembly specific for the canning industry, which provides operational efficiency and reduces maintenance demands. The assembly 100 includes both of greaseless linear bearings and a diamond-ground and coated shaft, promoting durable, smooth, and precise operation. By militating against the need for regular lubrication, the assembly 100 offers a sustainable and cost-effective solution, addressing common challenges faced in traditional canning equipment and streamlining the production process in the canning sector.

With reference to FIGS. 1-5, the assembly 100 can include a housing 102. Structurally, the housing 102 can encapsulate and support the various internal components of the assembly 100. In one embodiment, the housing 102 can have a cylindrical shape such that the housing has a circular cross section, which can accommodate the components of the assembly 100. The housing 102 can include a first end 104 and a second end 106 disposed opposite one another. The housing can have an outer surface 108 and an inner surface 110 defining a cavity 112 formed between the first end 104 and the second end 106.

Figure 4A:
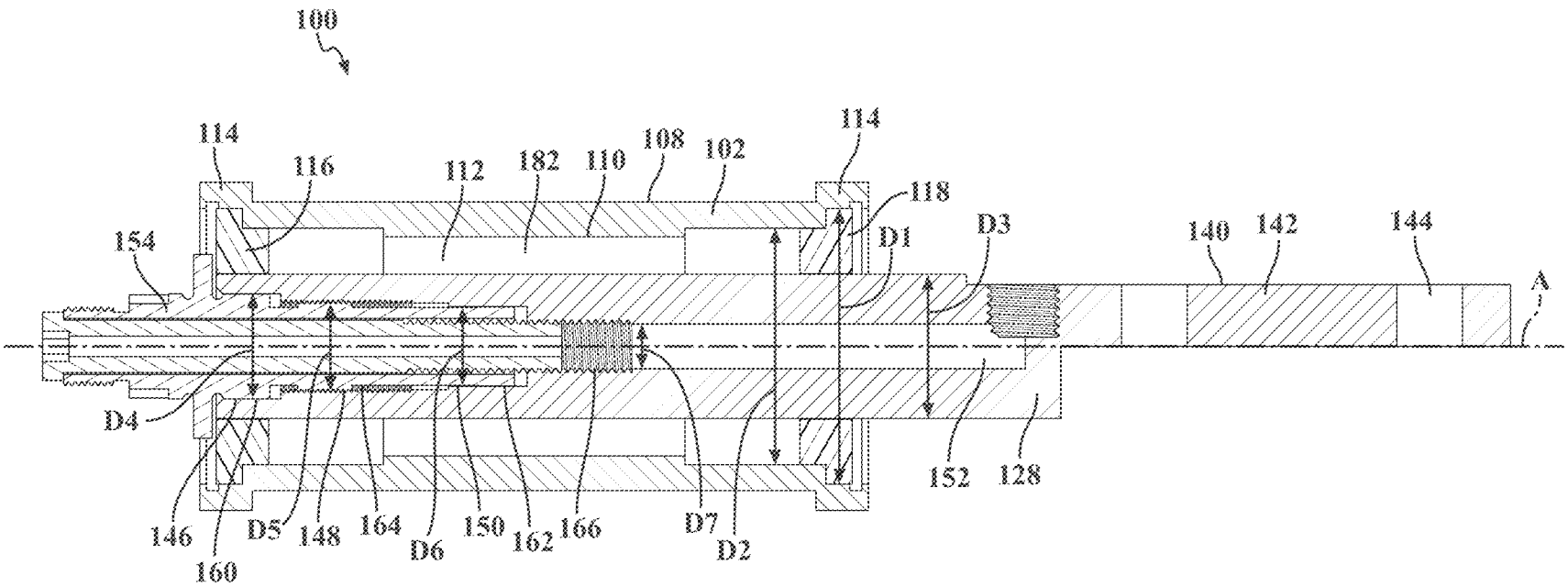
FIG. 4A is a side elevation cross sectional view of the linear bearing pusher and tooling assembly with a tooling adapter in a first position.
Figure 4B:
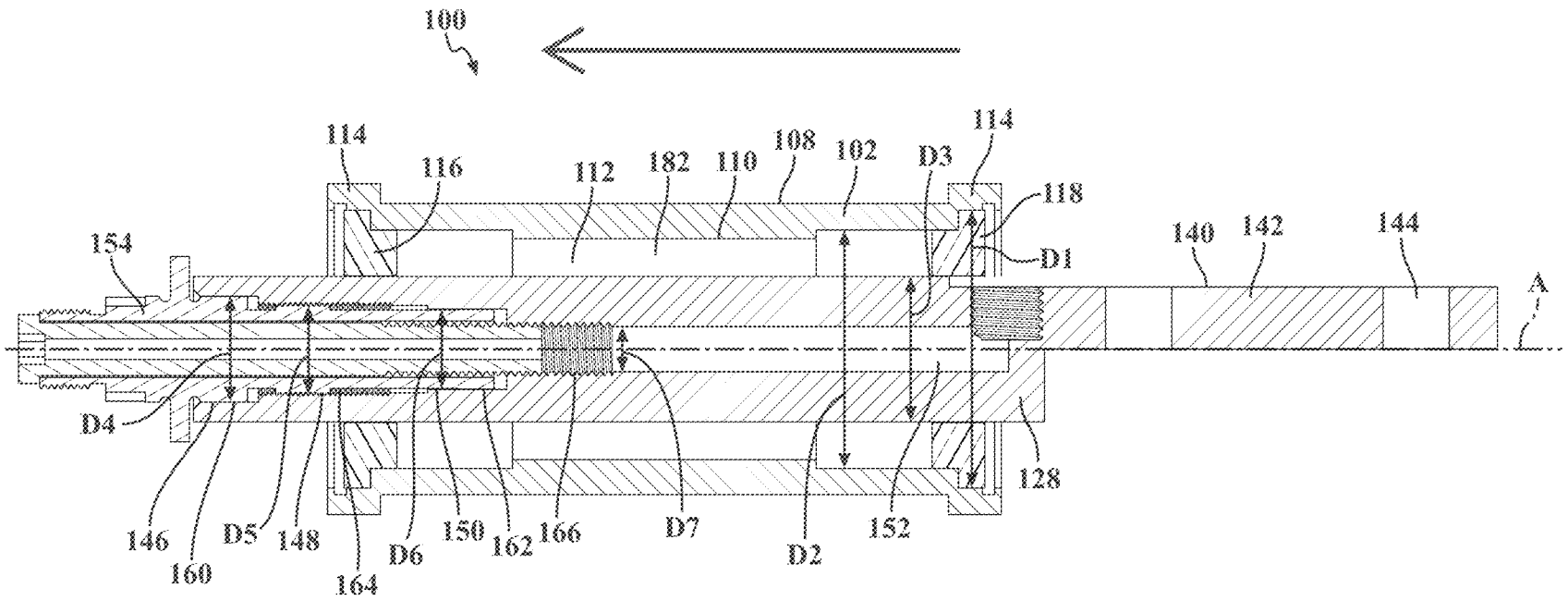
FIG. 4B is a side elevation cross sectional view of the linear bearing pusher and tooling assembly with the tooling adapter in a second position for interacting with a product in operation.

As shown in FIGS. 2 and 4, the housing 102 can provide a stable and secure environment for the internal components, protecting them from external contaminants and mechanical stresses. The housing 102 can facilitate proper alignment of the internal component and can assist with maintaining the positioning of the components during operation. The housing 102 can also aid in the dissipation of heat generated by the moving parts, contributing to the longevity and efficiency of the assembly 100.

As a non-limiting example, the housing 102 can be constructed from high-strength metals such as stainless steel or aluminum alloys. Stainless steel offers durability and resistance to corrosion, making it suitable for the harsh environments typically found in canning operations. Aluminum, while lighter than stainless steel, also provides good strength and thermal conductivity, which can be beneficial for heat dissipation. Additionally, the lighter weight of aluminum allows for the assembly 100 to be more lightweight and therefore, can require less energy for use. The choice of material can depend on specific application requirements, including weight considerations and exposure to corrosive substances. A skilled artisan can select suitable materials for the housing 102 within the scope of the present disclosure.

The wall thickness of the housing 102 can be sufficient to withstand operational stresses without compromising the weight and efficiency of the assembly 100. As a non-limiting example, the wall thickness of the housing 102 can range from about 3 to about 5 millimeters, providing a balance between structural integrity and material efficiency. A wall thickness within this range allows the housing to support the internal pressures and mechanical loads during high-speed operations while maintaining a manageable overall weight for the assembly 100. A skilled artisan can select suitable wall thickness for the housing 102 within the scope of the present disclosure.

With reference to FIG. 2, the housing 102 can include the inner surface 110 and the outer surface 108. The inner surface 110 can include treatments or coatings to minimize friction and wear over time. The outer surface 108 of the housing 102 can be formed to withstand the operational environment and, in certain embodiments, can include mounting features or interfaces for integration into the larger canning machinery. It should be appreciated that the housing 102 does not include apertures or indentations along the length of the housing 102 and can be formed as a solid piece. As discussed below, due to the ability of the assembly 100 to self-lubricate, lubrication apertures in the housing 102 are not required. In this way, the housing 102 can be a solid construction and further increase the structural stability of the housing 102. Advantageously, the housing 102 does not require aperture or holes which are required in an assembly that uses lubricants, such as grease. This solid construction further militates against debris from entering the assembly 100.

As shown in FIG. 4, the housing 102 can have a hollow interior and can include a first inside diameter (D1) and a second inside diameter (D2) at both ends of the housing. With reference to FIG. 4, the first inside diameter (D1) can be larger than the second inside diameter (D2). End portions 114 of the housing 102 that have the inside diameters (D1, D2) can accommodate receiving other components of the assembly 100 where the components can be received within the hollow interior of the assembly 100, discussed hereinbelow. For example, the end portions 114 of the housing 102 with the inside diameters (D1, D2) can accommodate bearings and/or any seals or caps that militates against any external elements from entering the hollow interior of the assembly 100. The stepped feature formed by the inside diameters (D1, D2) of the housing 102 not only facilitates the assembly and disassembly of the internal components of the assembly 100 but also helps in maintaining the alignment and operational accuracy of the assembly 100. The precise sizing of the first diameter (D1) and the second diameter (D2) ensures the seamless fit of components and the overall performance of the assembly 100.

It should be appreciated that the housing 102 can be a continuous and uninterrupted cylinder. This means that any potential openings or apertures in the housing are meticulously plugged or sealed, minimizing the introduction of debris, dust, or other contaminants that can enter into the hollow interior of the housing 102. This can be advantageous in environments like canning operations, where exposure to particulate matter is common. By militating against the ingress of debris, the housing 102 protects the internal components such as bearings, the shaft, and the tooling adapter from premature wear, extending the lifespan of the assembly.

The housing 102 can include a groove 119 formed adjacent the end portions 114 in the surface inner surface 110 of the hollow interior. The groove 119 can circumscribe the inner surface 110 of the hollow interior and be configured to removably receive a retention member 120. The retention member 120 can be a snap-ring, a seal, or the like to facilitate maintaining the internal components within the hollow interior of the housing. A skilled artisan can select a suitable retention member 120 as desired.

Figure 3:
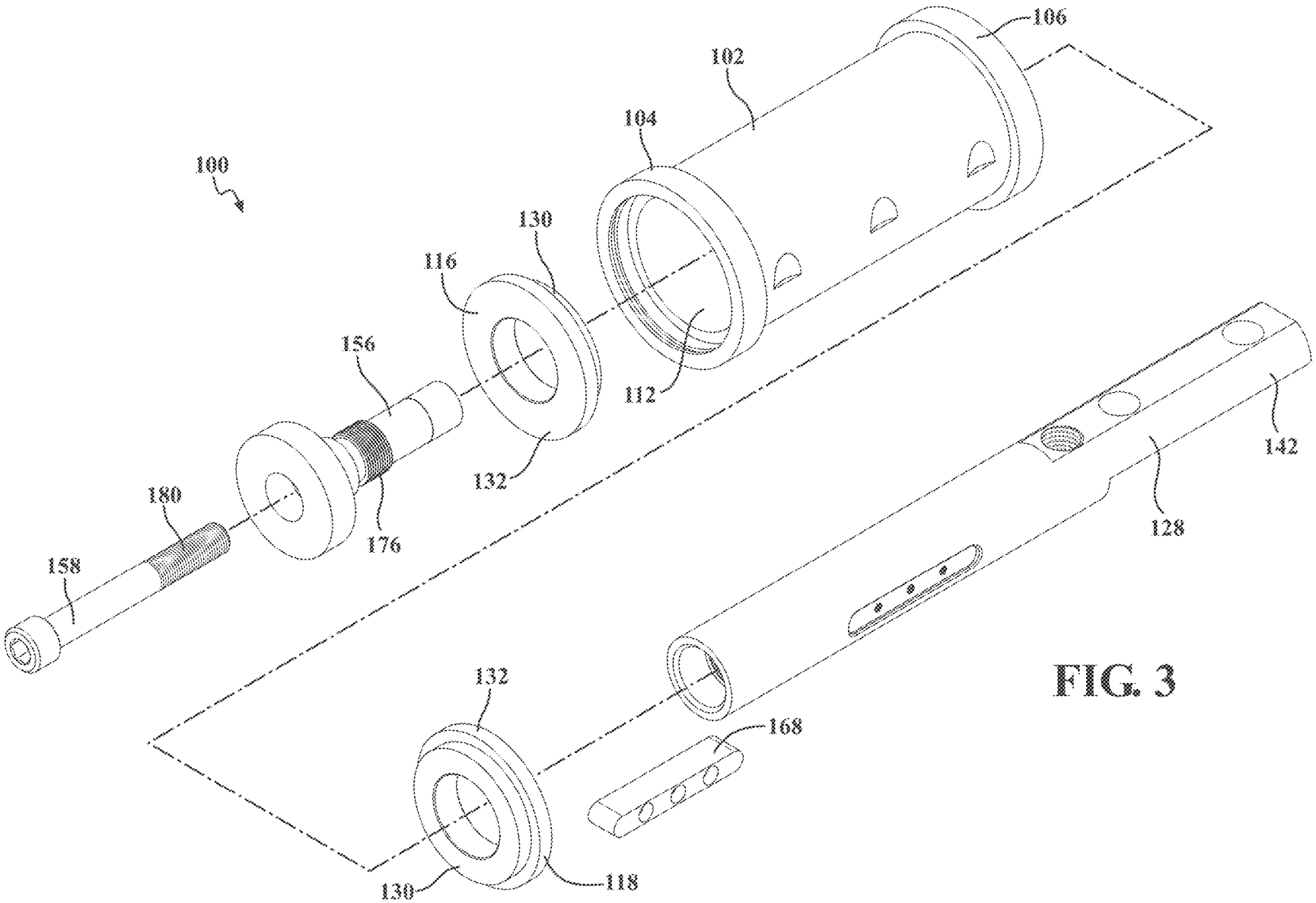
FIG. 3 is an exploded perspective view of the linear bearing pusher and tooling assembly with the pusher.
Figure 5:
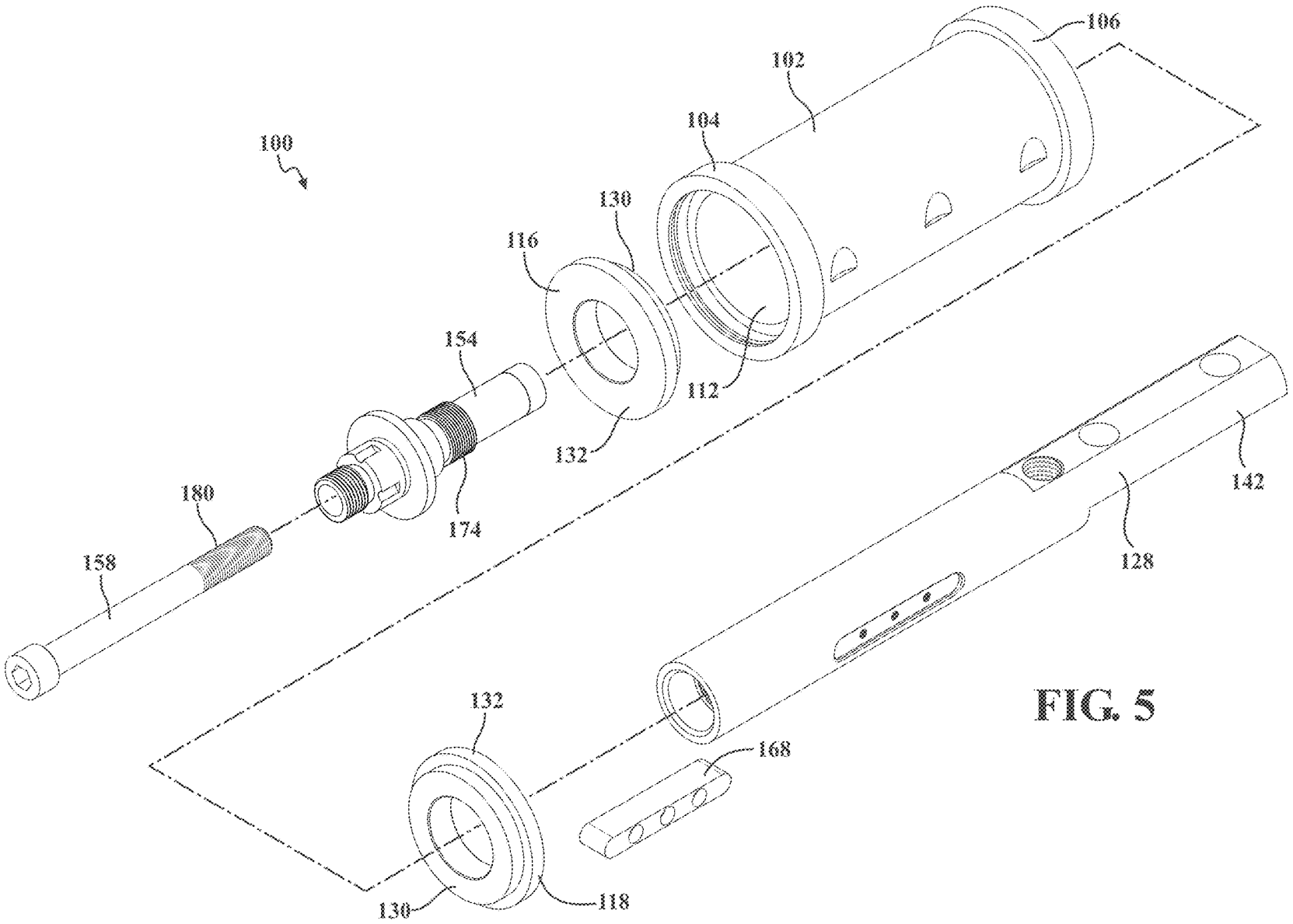
FIG. 5 is an exploded perspective view of the linear bearing pusher and tooling assembly with the tooling adapter.

With reference to FIGS. 3 and 5, the assembly 100 can include a first bearing 116 and second bearing 118. The first bearing 116 can be disposed adjacent the first end 104 of the housing 102 and the second bearing 118 can be disposed adjacent the second end 106 of the housing 102, as shown in FIGS. 2 and 4. Each bearing 116, 118 can include a circular cross-section with a hole that accommodates other internal components of the assembly 100, such as a shaft 128. In this way, the first bearing 116 can include a first hole 124 and the second bearing 118 can include a second hole 126.

The bearings 116, 118 can be constructed from materials that offer high durability and low friction characteristics. As a non-limiting example, common materials used for the bearings 116, 118 include ceramics like silicon nitride or zirconium dioxide, which are known for their hardness, wear resistance, and ability to operate under minimal lubrication conditions. In certain embodiments, the first bearing 116 and the second bearing 118 can be formed from polymer composites and engineered plastics, such as polytetrafluoroethylene (PTFE) or nylon, as examples, offering friction reduction and the ability to operate in a wide range of temperatures and chemical environments. In a specific example, the first bearing 116 and the second bearing 118 can be formed from PTFE and graphite. As a non-limiting example, the percent by weight of the composition for the first bearing 116 and the second bearing 118 can be between about 75% to about 95% of PTFE and about 25% to about 5% of graphite. In a most particular embodiment, the percent by weight of the composition for the first bearing 116 and the second bearing 118 can be about 85% of PTFE and about 15% of graphite. Each of these materials can be tailored to meet specific operational demands of the bearing application, ensuring optimal performance and longevity. It should be appreciated that the first bearing 116 and the second bearing 118 can be formed of different materials, as desired. A skilled artisan can select a suitable material and percent by weight composition for the first bearing 116 and the second bearing 118 within the scope of the present disclosure.

Each bearing 116, 118 can include a protrusion 130 that extends outward from a base 132 of the bearing 116, 118. The protrusion 130 can have a smaller diameter than the total diameter of the bearing, creating a stepwise progression along the outer edge of the bearing. This allows the bearing 116, 118 to be easily positioned within the housing 102, specifically within the end portions 114 that include the inside diameters (D1, D2). The stepwise feature of the bearings 116, 118 ensure a snug fit within the housing 102, militating against any lateral movement that could disrupt the operation and facilitating maintaining a desired axial alignment with the shaft 128. It should also be noted that in certain embodiments, the first bearing 116 can be removably coupled to the hollow interior of the housing 102 adjacent the first end 104 with the retention member 120 and the second bearing 118 can be removably coupled the hollow interior of the housing 102 adjacent to the second end 106 with another retention member 120.

Within the assembly 100, the bearings 116, 118 can be disposed at opposite ends of the housing 102, to axially align the shaft 128 with the housing 102 of the assembly 100. In this way, the bearings 116, 118 function to support the shaft 128 in operation as the shaft 128 moves between a first position, shown in FIGS. 2A and 2B, and a second position, shown in FIGS. 2B and 4B. The bearings 116, 118 can also allow for the shaft 128 and, in turn, the assembly 100, to effectively form cans without the need for grease or continuous lubrication. This greaseless operation is made possible through the choice of materials and the engineering of the surfaces of the bearings 116, 118. The lack of grease not only simplifies maintenance but also militates against contamination risks associated with grease use in food processing environments like canning. Furthermore, the reduced friction and smooth operation of the bearings 116, 118 lessens the wear on the shaft 128. This reduction in wear not only extends the life of the shaft 128 but also enhances the reliability and durability of the assembly 100, promoting consistent performance over extended periods. Desirably, the greaseless feature of the assembly 100 can be beneficial in high-speed applications where traditional lubrication methods might fail to provide consistent performance.

With reference to FIGS. 2-5, the assembly 100 can include the shaft 128. The shaft 128 can be movably disposed within the cavity 112 of the housing 102 between the first position and the second position. The shaft 128 can include a first portion 134 disposed through the first hole 124 of the first bearing 116 and a second portion 136 disposed through the second hole 126 of the second bearing 118. The shaft 128 in the first position, shown in FIGS. 2A and 2B, can be disposed within the housing 102 with only the second portion 136 of the shaft disposed outside the housing 102. The shaft 128 in the second position, shown in FIGS. 2B and 4B, can have the first portion 134 disposed outside of the housing 102. The shaft 128 can be configured to transmit a mechanical force, facilitating the manipulation of a workpiece required during can formation operations. The shaft 128 can move axially in a reciprocating manner within the bearings 116,118 the housing 102, driven by external mechanisms that are part of the larger can processing machine.

As shown in FIGS. 2 and 4, the shaft 128 can have an interior surface 138 and an exterior surface 140. The exterior surface 140 can include a friction reducing coating. The friction reducing coating can facilitate smooth operation of the assembly 100. The friction reducing coating can also facilitate an efficiency of the motion of the shaft within the bearings 116, 118 to minimize wear on the exterior surface 140 of the shaft 128 and/or the bearings 116, 118 and minimize frictional heat generation under high-speed conditions. Non-limiting examples of such friction reducing coatings include tungsten carbide, diamond-like carbon (DLC), or polytetrafluoroethylene (PTFE). In a particular embodiment the friction reducing coating can include a tungsten carbide powder. As a non-limiting example, the tungsten carbide powder can include a percent by weight of cobalt ranging between about 5% and about 15% cobalt and a percent by weight of chromium ranging between about 2% and about 6%. The friction reducing coating can be selected based on hardness, low friction coefficients, and resistance to wear and corrosion, which assisting with maintaining the efficiency and longevity of the assembly 100 under continuous operational stress. A skilled artisan can select a suitable friction reducing coating and composition thereof within the scope of the present disclosure.

It should be noted that shaft 128 can be formed from a material selected for its mechanical properties and suitability for the operational environment. Common materials include hardened steel, stainless steel, or alloys such as titanium, as examples, which provide the necessary strength, durability, and resistance to deformation. These materials aid the shaft 128 in withstanding the physical loads and stresses encountered during the canning process without bending or breaking. A skilled artisan can select a suitable material for the shaft 128 as desired.

In an embodiment, the shaft 128 can have a hard chrome plating disposed on the exterior surface 140 of the shaft 128 with the friction reducing coating disposed on the chrome plating. In a non-limiting example, the hard chrome plating can have a Rockwell hardness between about 60 HRC and about 70 HRC. In a more particular non-limiting example, the hard chrome plating can have a Rockwell hardness between about 68 HRC and about 72 HRC. A skilled artisan can select a suitable Rockwell hardness within the scope of the present disclosure. Advantageously, the hard chrome plating can enhance the hardness and durability of the shaft 128, making it more resistant to wear and tear, which can be helpful in high-friction environments where the shaft needs to maintain its integrity over prolonged operational periods. Additionally, the hard chrome plating provides corrosion resistance, militating against the shaft 128 from forming rust and other corrosive reactions that could compromise its strength and functionality. The smooth and shiny finish of the hard chrome plating can also facilitate reducing friction between the bearings 116, 118 and the shaft 128, allowing for smoother movement of shaft 128 between the bearings 116, 118, thereby improving the overall efficiency of the machinery.

In an embodiment, the shaft 128 can have an average roughness (Ra). In a non-limiting example, the Ra can be between about 5 microns to about 15 microns. In a more particular example, Ra can be between about 8 microns and about 12 microns. A skilled artisan can select a suitable average roughness within the scope of the present disclosure. This specific range of roughness can result in a low friction coefficient.

In certain embodiments, shown in FIG. 1, the shaft 128 can extend outside of the housing 102 beyond the second end 106 of the housing 102. The extension portion 142 of the shaft 128 allows for additional components or mechanisms to be attached to the shaft 128, facilitating integration with other parts of the can processing machine or for additional functionalities such as sensors or actuators. The extension portion 142 provides versatility and utility of the assembly 100 within the can processing machine. To this point and with continued reference to FIG. 1, the extension portion 142 of the shaft can include an aperture 144 and, in certain embodiments, multiple apertures 144. These apertures 144 can function as mounting points, allowing the entire assembly to be securely coupled to the can processing machine. The coupling of the assembly 100 to the can processing machine via the aperture 144 allows for stable operation, as it militates against vibrations and misalignments that could affect the precision and effectiveness of the can forming process.

With reference to FIGS. 2 and 4, shaft 128 can accommodate various components of the assembly 100. The interior of the shaft 128 can include multiple bores, specifically, a first bore 146, a second bore 148, a third bore 150, and a fourth bore 152, shown in FIG. 2. The bores can be positioned and dimensioned to facilitate the assembly and operation of a tooling adapter 154, a pusher 156, and a bolt 158.

With reference to FIGS. 2 and 4, the first bore 146 can have a first smooth surface 160 and the third bore 150 can have a smooth third surface 162. The second bore 148 can have a second threaded surface 164 and the fourth bore 152 can have a fourth threaded surface 166. The threaded surfaces 164, 166 can allow for secure coupling with other components of the assembly 100, such as the tooling adapter 154, the pusher 156, and the bolt 158. The threaded surfaces 164, 166 can provide a mechanical interface that allow components to be easily and securely coupled or uncoupled from the shaft 128, facilitating maintenance and adjustments without compromising the structural integrity or operational stability of the assembly 100.

It should be noted that the threading pattern of the threaded surfaces 164, 166 can vary between normal (right-handed) threads and reverse (left-handed) threads, depending on the specific operational requirements and the direction of motion or force applied during use. Reverse threads can be advantageous where the rotational forces applied during operation naturally tend to loosen components that are conventionally threaded. By employing reverse threads, the components of the assembly 100 can become tighter and more secure under operational conditions that involve reverse rotational movements. This can be desirable in high-speed environments where vibration and rotational forces are significant, as it effectively militates against the components of the assembly 100 from rotating with respect to each other, thus enhancing the overall reliability of the assembly 100.

With reference to FIG. 4, the shaft 128 can have a shaft outer diameter (D3) and a longitudinal axis (A). The first bore 146 can have a first bore diameter (D4), the second bore 148 can have a second bore diameter (D5), the third bore 150 can have a third bore diameter (D6), and t a fourth bore 152 can have a fourth bore diameter (D7), as shown in FIG. 4. Each of the first bore 146, the second bore 148, the third bore 150, and the fourth bore 152 can be coaxially aligned along the longitudinal axis (A). The bores 146, 148, 150, 152 can be configured to removably receive the tooling adapter 154 and the pusher 156.

As shown in FIG. 3, in some embodiments, the assembly 100 can include a key 168. Positioned within the housing 102, the key 168 can militate against the rotational movement of the shaft 128 within the housing 102 about the longitudinal axis (A), ensuring that the shaft 128 moves in a strictly linear fashion. The key 168 can also militate against the shaft 128 from being pushed out of the housing 102 along the longitudinal axis (A) while in operation. This allows for control over the tooling and pusher mechanisms, which directly impacts the quality and consistency of the canning process.

The key 168 can be coupled to the shaft 128 via at least one key fastener 170. The at least one key fastener 170 can extend into the shaft in a direction orthogonal to the longitudinal axis (A). The at least one key fastener 170 can extend into the shaft a fastener distance (FD) that is less than a shaft wall thickness (T). The shaft wall thickness can be defined as half a difference of the shaft outer diameter (D3) and the fourth bore diameter (D6). The key can also be configured to engage with a key slot 172 inside the housing 102. The engagement locks the shaft 128 in the desired orientation, militating against unwanted rotation that could lead to misalignment or uneven wear of the components. The ability of the key to militate against rotation not only prolongs the lifespan of the assembly by minimizing mechanical stress but also promotes consistent operation over time.

It should be noted that the key 168 can be made from durable materials such as hardened steel or specialized alloys to allow the key to withstand the high forces and repetitive movements encountered in industrial settings. This durability assists with maintaining the integrity of the key-slot engagement, especially under the high loads and speeds characteristic of modern canning operations.

As described hereinabove and as shown in FIGS. 4-5, the assembly 100 can include the tooling adapter 154. The tooling adapter 154 can interface directly with the operational tools used in canning processes. The tooling adapter 154 can have a threaded tooling adapter exterior surface 174 that can be received in the interior of the shaft 128 and threadably engage with the second threaded surface 164 of the second bore 148 of the shaft 128. The threaded engagement promotes a secure and stable connection between the shaft 128 and the tooling adapter 154, allowing for the transmission of linear forces without slippage or misalignment.

It should be appreciated that the tooling adapter 154 can hold, guide, and shape the can during operation. The tooling adapter 154 can allow for the linear bearing pusher and tooling assembly 100 to couple to various tools or dies that perform specific tasks, such as reducing the diameter of the can neck or creating specific features on the can. The tooling attachments that couple to the tooling adapter 154 can guide the can into the correct position to facilitate can alignment.

In operation, the tooling adapter 154 works to effectively transfer the necessary mechanical actions to the tooling used for shaping the cans. The tooling adapter 154 receives the tooling, which can vary depending on the specific requirements of the canning process, such as forming, cutting, or crimping. The tooling adapter 154 allows for quick changes of these tooling components, facilitating versatility and efficiency in production. In operation, the pusher 156 moves linearly along the longitudinal axis (A) to apply consistent pressure on the can. This capability is particularly valuable in production environments where multiple can sizes and shapes are manufactured, requiring frequent tool changes.

As described hereinabove, and as shown in FIGS. 1-3, the assembly 100 can include the pusher 156. The pusher 156 can interface directly with the operational tools used in canning processes. The pusher 156 can have a threaded pusher exterior surface 176 that can be received by the shaft 128 and can be threadably engaged with the second threaded surface 164 of the second bore 148 of the shaft 128, as shown in FIG. 3. The threaded engagement promotes a secure and stable connection between the shaft 128 and the pusher 156, allowing for the transmission of linear forces without slippage or misalignment.

In operation, the pusher 156 can exert force on the can during the necking process by pushing against the can to help form the neck and shape the can as required. The pusher 156 can provide the necessary pressure to deform the neck of the can accurately. In operation, the pusher 156 moves linearly along the longitudinal axis (A) to apply consistent pressure on the can. In this way, the pusher 156 can help to maintain the correct shape and dimensions as the can moves through different stages of the manufacturing process.

It should be appreciated that, in operation, the assembly 100 with a the tooling adapter 154 can be disposed opposite a second assembly 100' with the pusher 156. The assemblies 100, 100' can be disposed opposite one another with the tooling adapter 154 and the pusher 156 facing each other. In this way, the tooling adapter 154 can engage with a first side of the product and the pusher 156 can engage with a second side of the product opposite the first side.

The materials selected for the tooling adapter 154 and the pusher 156 are chosen for their strength, durability, and resistance to wear. Commonly, materials such as hardened steel or high-grade alloys are used. These materials are capable of withstanding the intense forces and corrosive environments often encountered in industrial settings. A skilled artisan can select a suitable material for the tooling adapter 154 and pusher 156, as desired.

With reference to FIGS. 2-5, the assembly 100 can include the bolt 158. The bolt 158 can be disposed through either the pusher 156 or the tooling adapter 154, depending on whether the pusher 156 or the tooling adapter 154 is required for operation. The bolt 158 can also further attach the pusher 156 or the tooling adapter 154 to the shaft 128, as shown in FIG. 2. The bolt 158 can have a threaded bolt exterior surface 180 that is threadably engaged with the fourth threaded surface 166 of the fourth bore 152 of the shaft 128. In certain embodiments, the fourth threaded surface 166 of the fourth bore 152 of the shaft 128 and the threaded bolt exterior surface 180 are reverse threaded. As described hereinabove, reverse threads can be advantageous where the rotational forces applied during operation naturally tend to loosen components that are conventionally threaded. By employing reverse threads, the assembly components can become tighter and more secure under operational conditions that involve reverse rotational movements.

In certain embodiments, the assembly 100 can include an air pocket 182 defined by a volume disposed between the inner surface 110 of the housing 102 and the exterior surface 140 of the shaft 128, as shown in FIG. 2. The air pocket 182 facilitates a greaseless operation by the assembly 100. The air pocket 182 effectively acts as a buffer zone that allows the shaft 128 to move smoothly within the housing 102 with minimal frictional contact with other components and without the need for traditional lubrication. The absence of grease or oil means that there is a minimized risk of contamination from dirt or debris that typically accumulates in lubricants over time. This results in a cleaner system that maintains its efficiency and reliability without the need for continuous cleaning or lubricant replenishment.

Moreover, the greaseless nature of the assembly 100 reduces the environmental impact associated with the disposal and management of used lubricants. The greaseless nature also lowers operational costs by reducing the need to purchase and store lubricants as well as minimizing labor costs associated with applying lubricants. Additionally, the presence of the air pocket 182 reduces the overall weight of the assembly 100. This reduction in weight can lead to improved energy efficiency, as less energy is required to move the assembly parts.

As shown in FIGS. 6A-6D, the present disclosure also provides a product manufacturing system 200. The system 200 can include a product indexing machine 202, a first linear bearing pusher and tooling assembly 204, a second linear bearing pusher and tooling assembly 206, and a first tooling 208. In operation, the system 200 allows for a seamless transformation of raw materials into a finished product. As a non-liming example, the product to be manufactured can be a can.

The product indexing machine 202 can be a conventional product indexing machine used in a-manufacturing setting to move the product between various processing stations. The machine 202 ensures that the product is accurately positioned correctly with respect to the first tooling 208 and the pusher 156 at each of a first processing location 212 and a second processing location 214, respectively, which promotes consistency and quality in the manufacturing process. The precise control of the indexing machine 202 over the movement of the product streamlines the production flow and minimizes errors or misalignments that could affect the final output.

The first linear bearing pusher and tooling assembly 204 can be disposed at the first processing location 212 and the second linear bearing pusher and tooling assembly 206 can be disposed at the second processing location 214 within the system 200. Each of the first linear bearing pusher and tooling assembly 204 and the second linear bearing pusher and tooling assembly 206 can be placed to engage with the product at different stages of its formation. The first linear bearing pusher and tooling assembly 204 and the second linear bearing pusher and tooling assembly 206 can be the linear bearing pusher and tooling assembly 100 as described hereinabove.

The product can encounter the first linear bearing pusher and tooling assembly 204 and the first tooling 208 installed at the first processing location 21. As the product moves to the second processing location 214 via the product indexing machine 202, the product can encounter the pusher 156 attached to the second linear bearing pusher and tooling assembly 206. The first tooling 208 is configured to perform operations on the product, such as crimping, cutting, or decorating. The pusher 156 is configured to exert force on the can by pushing against the can to help form the neck and shape the can as required. The pusher 156 exerts the necessary pressure to deform the neck of the can accurately. The variation in attachments on the linear bearing pusher and tooling assembly 100 between the first processing location 212 and second processing location 214 allows for a multi-step manufacturing process within the same system, enhancing efficiency and versatility.

Figure 6:
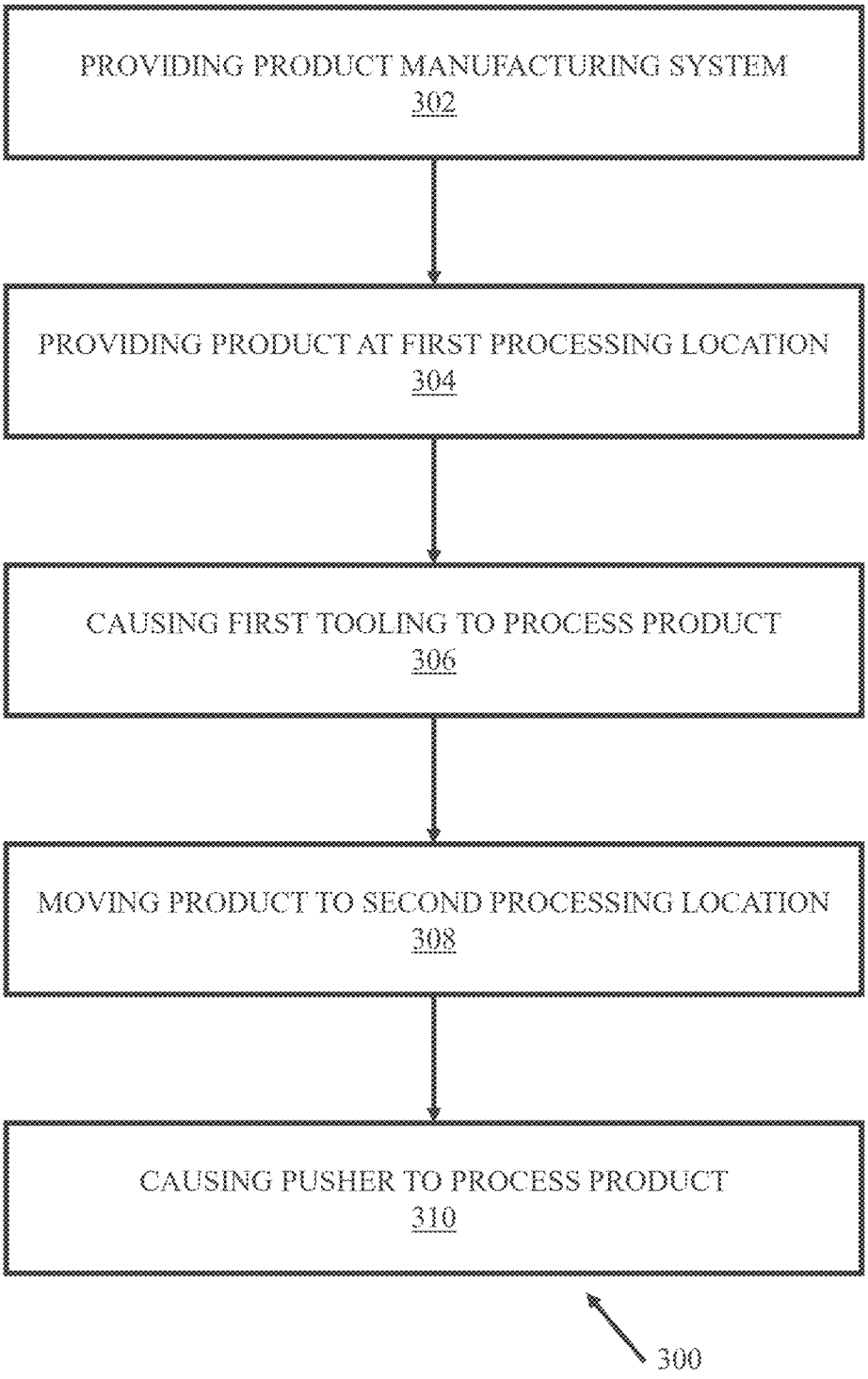
FIG. 6 is a flow diagram depicting a method for forming a product via product indexing machine.

With reference to FIG. 6, the present disclosure further provides a method 300 for forming a product via product indexing machine 202. In a step 302, the product manufacturing system 200 of the present disclosure is provided and in a step 304, the product can be provided at the first processing location 212. The first tooling 208 can process the product by an operation of the first linear bearing pusher and tooling assembly 204 in a step 306. The method 300 can include a step 308 of moving the product from the first processing location 212 to the second processing location 214. The pusher 156 can process the product by an operation of the second linear bearing pusher and tooling assembly 206 in a step 310 whereby the product is manufactured.

In certain embodiments where the product is a can, the method 300 can manufacture the can at a rate between about 2900 cans per minute and about 3200 cans per minute. In a particular example, the method 300 can manufacture the can at a rate of about 3040 cans per minute. It should be appreciated that the greaseless and lightweight nature of the system 200 can provide for an increased manufacturing rate when compared to conventional manufacturing rates. A skilled artisan can select a suitable rate of manufacture within the scope of the present disclosure.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A linear bearing pusher and tooling assembly, comprising:

a housing having a first end, a second end, an outer surface, and an inner surface, and the inner surface defining a cavity;

a first bearing having a first hole formed therethrough, the first bearing positioned at the first end of the housing;

a second bearing having a second hole formed therethrough, the second bearing positioned at the second end of the housing;

a shaft movably disposed within the cavity of the housing, the shaft having a first portion and a second portion, the first portion of the shaft disposed through the first hole of the first bearing and the second portion disposed through the second hole of the second bearing, the shaft having an interior surface and an exterior surface, the exterior surface having a friction reducing coating;

one of a tooling adapter disposed inside the shaft;

a pusher disposed inside the shaft; and a bolt disposed through and attaching one of the pusher and the tooling adapter to the shaft, whereby the shaft is permitted to move in a reciprocating manner within the housing without grease.

2. The linear bearing pusher and tooling assembly of claim 1, wherein the friction reducing coating on the exterior surface of the shaft includes tungsten carbide powder.

3. The linear bearing pusher and tooling assembly of claim 1, wherein there is a hard chrome plating between the exterior of the shaft and the friction reducing coating, and the hard chrome plating having a Rockwell hardness of between about 68 HRC and about 72 HRC.

4. The linear bearing pusher and tooling assembly of claim 1, wherein the shaft has a shaft outer diameter and a longitudinal axis, and interior surface of the shaft has a first bore with a first bore diameter, a second bore with a second bore diameter, a third bore with a third bore diameter, and a fourth bore with a fourth bore diameter, and each of the first bore, the second bore, the third bore, and the fourth bore are coaxially aligned along the longitudinal axis.

5. The linear bearing pusher and tooling assembly of claim 4, wherein the first bore has a first smooth surface, the second bore has a second threaded surface, the third bore has a third smooth surface, and the fourth bore has a fourth threaded surface.

6. The linear bearing pusher and tooling assembly of claim 5, wherein the tool adapter has a threaded tooling adapter exterior surface that is threadably engaged with the second threaded surface of the second bore of the shaft.

7. The linear bearing pusher and tooling assembly of claim 5, wherein the pusher has a threaded pusher exterior surface that is threadedly engaged with the second threaded surface of the second bore of the shaft.

8. The linear bearing pusher and tooling assembly of claim 5, wherein the bolt has a threaded bolt exterior surface that is threadably engaged with the fourth threaded surface of the fourth bore of the shaft.

9. The linear bearing pusher and tooling assembly of claim 8, wherein the fourth threaded surface of the fourth bore of the shaft and the threaded bolt exterior surface are reverse threaded.

10. The linear bearing pusher and tooling assembly of claim 4, further including a key coupled to the shaft with at least one key fastener, the at least one key fastener extending into the shaft in a direction orthogonal to the longitudinal axis a fastener distance that is less than a shaft wall thickness, the shaft wall thickness defined as half a difference of the shaft outer diameter and the fourth bore diameter.

11. The linear bearing pusher and tooling assembly of claim 10, wherein the inner surface of the housing has a key slot and the key is engaged with the key slot.

12. The linear bearing pusher and tooling assembly of claim 10, wherein the key is configured to militate against a rotation of the shaft within the housing about the longitudinal axis.

13. The linear bearing pusher and tooling assembly of claim 1, wherein the first bearing and the second bearing are made of polytetrafluoroethylene and graphite.

14. The linear bearing pusher and tooling assembly of claim 1, wherein the housing is a continuous and uninterrupted cylinder.

15. The linear bearing pusher and tooling assembly of claim 1, wherein the shaft has an average surface roughness (Ra) between about 8 micrometer and 12 micrometer.

16. The linear bearing pusher and tooling assembly of claim 1, further comprising an air pocket defined by a volume disposed between the inner surface of the housing and the exterior surface of the shaft.

17. The linear bearing pusher and tooling assembly of claim 1, wherein the first bearing is removably attached to the first end of the housing with a first bearing fastener and the second bearing is removably attached to the second end of the housing with a second bearing fastener.

18. A product manufacturing system, comprising:

a product indexing machine configured to move a product from a first processing location to a second processing location;

a plurality of linear bearing pusher assemblies, including a first linear bearing pusher and tooling assembly disposed at the first processing location and a second linear bearing pusher and tooling assembly disposed at the second processing location, each of the linear bearing pusher assemblies having a housing having a first end, a second end, an outer surface, and an inner surface, and the inner surface defining a cavity, a first bearing having a first hole formed therethrough, the first bearing positioned at the first end of the housing, a second bearing having a second hole formed therethrough, the second bearing positioned at the second end of the housing, a shaft movably disposed within the cavity of the housing, the shaft having a first portion and a second portion, the first portion of the shaft disposed through the first hole of the first bearing and the second portion disposed through the second hole of the second bearing, the shaft having an interior surface and an exterior surface, the exterior surface having a friction reducing coating, one of a tooling adapter disposed inside the shaft, a pusher disposed inside the shaft, and a bolt disposed through and attaching the pusher and the tooling adapter to the shaft, whereby the shaft is permitted to move in a reciprocating manner within the housing without grease; and a first tooling attached to the tooling adapter of the first linear bearing pusher and tooling assembly, the first tooling configured to process the product at the first processing location, wherein the second linear bearing pusher and tooling assembly includes the pusher, and whereby the product is manufactured after being processed at each of the first processing location and the second processing location.

19. The product manufacturing system of claim 18, wherein the product is a can to be manufactured.

20. A method for forming a product via product indexing machine, comprising steps of:

providing the product manufacturing system of claim 18;

providing the product at the first processing location;

causing the first tooling to process the product by an operation of the first linear bearing pusher and tooling assembly;

moving the product from the first processing location to the second processing location; and causing the pusher to process the product by an operation of the second linear bearing pusher and tooling assembly, whereby the product is manufactured.

* * * * *